US008863862B1

(12) United States Patent
Parmentier

(10) Patent No.: US 8,863,862 B1
(45) Date of Patent: Oct. 21, 2014

(54) LATERAL DRILLING TOOL AND METHOD FROM VERTICAL BORE HOLE

(76) Inventor: Paul Pierre Parmentier, Walnut, CA (US)

( * ) Notice: Subject to any disclaimer, the term of this patent is extended or adjusted under 35 U.S.C. 154(b) by 583 days.

(21) Appl. No.: 13/158,405

(22) Filed: Jun. 11, 2011

Related U.S. Application Data

(60) Provisional application No. 61/357,092, filed on Jun. 22, 2010.

(51) Int. Cl.
*E21B 49/06* (2006.01)

(52) U.S. Cl.
CPC ..... *E21B 49/06* (2013.01)
USPC ..... 175/78; 175/77; 175/62

(58) Field of Classification Search
CPC ..... E21B 49/06; E21B 7/046
USPC ..... 175/77, 78, 62
See application file for complete search history.

(56) References Cited

U.S. PATENT DOCUMENTS

| | | | | |
|---|---|---|---|---|
| 2,889,137 | A * | 6/1959 | Walker | 175/52 |
| 3,301,337 | A | 1/1967 | Vaughn et al. | |
| 4,082,248 | A | 4/1978 | Hinrichsen | |
| 4,159,819 | A | 7/1979 | Bargel et al. | |
| 4,372,389 | A * | 2/1983 | Hamrick et al. | 166/369 |
| 4,671,703 | A | 6/1987 | Schmidt | |
| 4,936,709 | A | 6/1990 | Kimura | |
| 5,622,231 | A | 4/1997 | Thompson | |
| 6,199,633 | B1 | 3/2001 | Longbottom | |
| 6,276,453 | B1 | 8/2001 | Bond | |
| 6,561,732 | B1 | 5/2003 | Bloomfield et al. | |
| 7,422,059 | B2 | 9/2008 | Jelsma | |
| 2005/0167160 | A1 | 8/2005 | Billingsley | |
| 2006/0137912 | A1 | 6/2006 | Billingsley | |
| 2007/0095530 | A1 | 5/2007 | Jelsma | |
| 2007/0151765 | A1 | 7/2007 | Billingsley | |
| 2008/0164065 | A1 | 7/2008 | Orban et al. | |
| 2009/0272547 | A1 | 11/2009 | Dale et al. | |
| 2009/0288884 | A1 | 11/2009 | Jelsma | |
| 2013/0199851 | A1 * | 8/2013 | Koch et al. | 175/62 |

* cited by examiner

*Primary Examiner* — Giovanna Wright
(74) *Attorney, Agent, or Firm* — David L. Hoffman; Hoffman Patent Group

(57) ABSTRACT

A lateral drilling system includes a device for drilling a first bore hole, preferably vertical or substantially vertical, and including a tool for boring a second bore hole in a direction transverse, preferably normal or substantially normal, to the first bore hole. The vertical boring tool may be any vertical boring device. A casing for the first bore hole may be used. The tool for boring the second bore hole includes a pipe launching section and a pipe receiving section. There is also a removable rack for holding a supply of pipe segments, each segment having a lead end of reduced diameter for fitting into a tail end of a preceding pipe segment, so that the segments form a conduit which may be used to treat surrounding ground. The tool includes a frame for holding the pipe receiving section, pipe launching section and pipe launching mechanism. The pipe launching mechanism includes a pushing arm and a power source to push each pipe segment one by one into the ground. A stabilizing mechanism may also be used to stabilize the device's frame.

18 Claims, 17 Drawing Sheets

Figure 1B: Prior Art
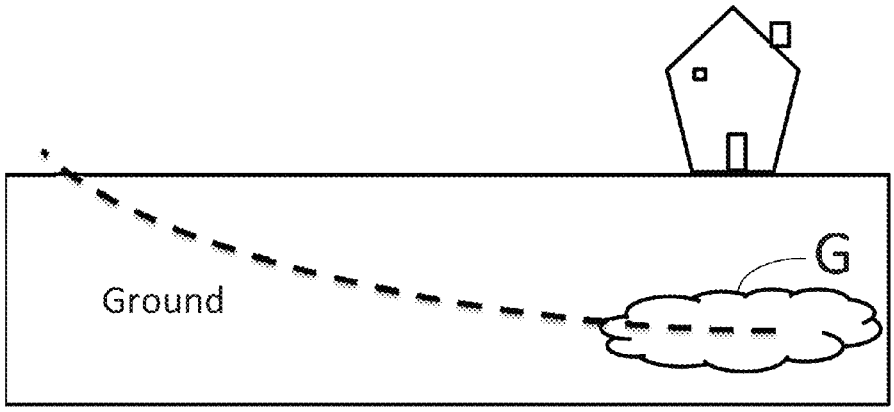
Figure 1C
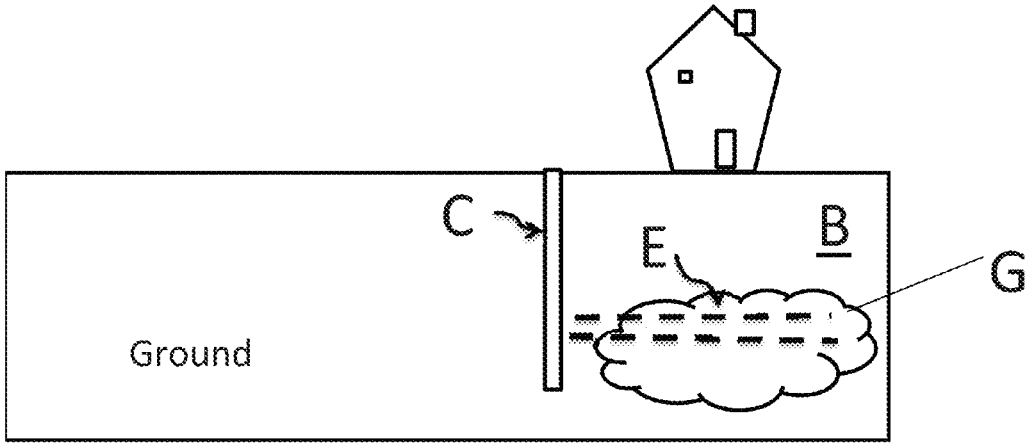

LATERAL DRILLING TOOL AND METHOD FROM VERTICAL BORE HOLE

CROSS REFERENCE TO RELATED APPLICATION(S)

This application claims priority from U.S. Provisional Patent Application Ser. No. 61/357,092, filed Jun. 22, 2010, and which is incorporated by reference herein.

BACKGROUND OF THE INVENTION

1. Field of the Invention

The present invention relates to a lateral drilling system, a lateral drilling tool and a method for drilling laterally from a vertical bore hole in the ground to bore lateral holes, termed herein as "roots" or "lateral roots."

2. Description of the Related Art

There have been many attempts to design a device and method for laterally drilling from a vertical bore hole. U.S. Pat. No. 3,301,337 to Vaughn et al, issued Jan. 31, 1967, describes an apparatus for completing a well by pushing a plurality of conduit sections laterally with respect to a bore hole in a formation. This apparatus uses a hydraulic piston activated with a sucker rod with a ten-foot long stroke that operates a twelve-degree wedge to insert successive one and a half inch long conduit pieces that can be perforated to allow fluid flow. The long-piston stroke design was introduced to generate high force to allow the tool to penetrate resistant steel casings and well wall material in oil and gas production operations.

In the Vaughn tool, power to an upper piston is activated by a vertical rod connected to the surface and activated by equipment at the surface. In this design, a significant vertical downward force is necessary to activate the upper piston. Such force requires a strong anchorage of the tool. The Vaughn design includes a set of serrated grips at the base of the tool that are wedged against the casing prior to operation of the tool. Such gripping of the inner hard surface of the area to be drilled can be expected to be effective on hard surfaces, i.e., rock or the inside of a well casing. In softer soil such as clay or silt, where steady gripping is not possible, this requirement for gripping of rock for bracing would make this Vaughn design unusable or at least very impractical.

Similarly, when upwardly thrusting the wedge during the pipe insertion phase, the tool would tend to be pushed downward. This downward push would be expected to occur even if hydraulic power were supplied from the surface through a hydraulic power line. The Vaughn design includes the lower grip portion of the tool to immobilize the tool. Under the intent of penetrating softer soil, anchoring the tool to the side of the bore hole cannot be achieved effectively, and the wedge's upward thrusting energy would be commensurately lost to downward slide of the tool, reducing the intended force of penetration. Besides the loss of penetrating power, this downward push under the Vaughn design in soft soil would also result in vertical displacement of the tool due to unsecure anchoring. This vertical displacement would cause an inability to align each successive pipe segment to the previously installed pipe segment.

The Vaughn tool is operated by a sucker rod to activate the piston. That sucker rod must be activated from the surface with a drilling rig or heavy pipe handling equipment. The tool requires a cap at the upper part of the tool as part of the control of the sucker rod used to activate the piston. The cap appears to prevent the option of a removable pipe segment rack.

A wedge-activated system such as described by Vaughn results in pipe sections only about one and a half inches long, because of the spacing requirement of the Vaughn wedge and anvil components. The spacing requirements for the wedge and anvil also would appear to preclude a side-by-side installation of two pipe inserting units.

U.S. Pat. No. 5,622,231 to Thompson, issued Apr. 22, 1997, is directed to a method for forming substantially lateral bore holes from within a vertical shaft, with a rotating drilling tool. A drill bit is gradually pushed farther into the lateral bore hole by successive insertions of shims. This system uses a rotating bit to drill the lateral bore and is complex.

U.S. Patent Application Publication Nos. 2005/0167160 and 2007/0151765 to Billingsley, 2005 and 2007, respectively, describe a drilling tool operated as a hydraulically powered drill bit to insert successive three-inch segments. This system also uses a drilling bit and is a complex device.

U.S. Patent Application Publication No. 2008/0164065 to Orban et al, 2008, discloses an on-site fabrication of a tubular member formed from a rolled band of metal that is used as a drilling bit.

U.S. Pat. No. 6,561,732 to Bloomfield et al, issued May 2003, describes construction of lateral pipes, including the use of slits and other configurations to allow passage of fluids.

Other patents such as Bond (U.S. Pat. No. 6,276,453), Jelsma (U.S. Pat. No. 7,422,059), Kimura (U.S. Pat. No. 4,936,709) and Schmidt (U.S. Pat. No. 4,671,703) relate to certain aspects of bore holes and/or lateral drilling.

SUMMARY OF THE INVENTION

It would be desirable to insert longer pipe sections or segments relative to a vertical bore hole diameter, and to bore laterally faster, less expensively and in softer soils such as clay. Besides cost and time savings, longer segments also allow for three significant improvements:

i. a longer pipe can support a proportionally higher density of holes than shorter sections, as part of the each pipe segment is reserved for overlapping with the preceding pipe section. Higher density of openings in the final segmented total pipe length improves fluid flow into or out of the pipe.

ii. The longer possible length of pipe section relative to the vertical bore hole diameter also allows for the first pipe segment to be tapered to a more pointed shape providing a more effective penetrating leading end of the segmented pipe.

iii. The last pipe section of each segmented pipe built by the lateral drilling tool can be designed with an angled surface or with a hose connection for later access.

It is also desirable to have a removable pipe rack and an easy system for loading pipes into a launching position, and for delivering pipes into and out of the tool.

In accordance with one embodiment of the invention, there is a lateral drilling system that includes a device for drilling a first bore hole, preferably vertical or substantially vertical, and including a tool for boring a second bore hole in a direction transverse, preferably normal or substantially normal, to the first bore hole.

The vertical boring tool may be any vertical boring device, as is well known in the art. A casing for the first bore hole may be used.

The tool for boring the second bore hole includes a pipe launching section and a pipe receiving section. There is also a pipe rack for holding a supply of pipe sections or segments, each segment having a first end or lead end of reduced diameter for fitting into a second end or tail end of a preceding pipe segment, so that the successive segments form a pipe or conduit. Each segment also preferably has openings or slits to enable fluid or other contaminants in the soil to be pulled through the slits, into the conduit, and then removed from the conduit via the first bore hole, and to enable fluid or other treatment to be delivered from inside the conduit to the surrounding soil. The fluids can also be injected from the vertical bore hole into the soil in a reverse fluid flow.

There is also a jaw having a power source for launching pipe segments laterally. The tool includes a frame for holding the pipe receiving section, pipe launching section and pipe launching mechanism, including the jaw and power source. A stabilizing mechanism may also be used to stabilize the frame inside the first (vertical) bore hole.

The pipe sections are preferably loaded into a magazine or pipe holding rack, which is inserted into the first bore hole and the frame. The launching device, includes the jaw, which opens up to push the pipe segments one by one in a desired lateral direction from the first bore hole.

The jaw preferably includes at least the one arm ("pushing arm") that pushes the pipe segments, the pipe segments being loaded one by one into a launching position, where they preferably lay on a rail set (dual rails), which is preferably two blocks with an opening there between extending in the launching direction. The pushing arm will push the second or rear end of the pipe segment that is in the launching position in the lateral direction (an axial direction of the second bore hole) a sufficient distance and will retract back to a starting position. This enables a bottom most pipe segment in the rack to be pushed out of the rack by a hammer device, and fall by gravity into the launching position.

The jaw is hydraulically powered in a preferred embodiment. It may also be powered pneumatically, electrically or sonically.

Preferably, the system and tool may be used in softer soils, especially clay. Other soils that the system and tool may be used with include but are not necessarily limited to silt, sand, organics and may be adapted for gravel and/or shale (hardened clay).

Preferably, the system and tool may be used at depths just below the surface, e.g., about twenty to 200 feet deep, and this preferred depth range may vary plus or minus fifty percent. The device may be used at other depths as well. In cases where it is adapted to work in rock, it may be used at thousands of feet in depth.

In a preferred embodiment, the first bore hole is vertical or substantially vertical (e.g., substantially being defined as within plus or minus fifteen degrees of vertical, more preferably within plus or minus ten degrees of vertical and most preferably within plus or minus five degrees of vertical).

Also in a preferred embodiment, the second bore hole is horizontal or substantially horizontal (e.g., substantially being defined as within plus or minus fifteen degrees of horizontal or normal to the first bore hole, more preferably within plus or minus ten degrees of horizontal or normal to the first bore hole and most preferably within plus or minus five degrees of horizontal or normal to the first bore hole).

The tool for lateral boring may be vertically stabilized to ensure alignment of the pipe segments being inserted, but in some embodiments does not need to be vertically immobilized. A counteracting force to a force of the pipe segment being launched is diametrically opposite the drilling area, so vertical sliding of the tool or jaw is not an issue. There is no vertical kickback component, or only a negligible amount.

The use of a jaw enables a long launch stroke in relation to the diameter of the first bore hole, enabling pipe sections that have a length greater than a radius of the first bore hole, and preferably seventy percent up to about ninety or ninety five percent of the diameter of the first bore hole.

In a most preferred embodiment, the tool can be operated with wire line equipment and a surface hydraulic pressure unit, significantly reducing the equipment requirements and associated costs.

The system includes a pipe section loading rack that allows re-loading of pipe sections without removal of the whole drilling tool. This ability to shuttle pipe supplies from the surface to the tool offers significant time savings and allows for specific designs of the well length and type of pipe sections inserted be being able to select the type of individual pipe segment. This mobile pipe rack offers the option to adapt to soil conditions. For example, running into rock which may be unsuitable for boring through (such as a condition where the lead pipe encounters a hard boulder), may be compensated for by simply vertically adjusting the tool's depth and therefore the launch position depth, and/or by rotating the tool to circumferentially adjust the launch angle. Adjustments can also be made by removing the rack, and readjusting the pipe segments therein to put a last pipe segment in the bottom most position, then returning the rack into the tool. This way the length of the lateral run can be ended or lengthened, when lateral drilling no longer is effective or is encountering softer soil, thereby matching field requirements. The removable rack also enables easy changing of the type of pipe segments depending on any field conditions that are encountered.

Where the diameter of the first bore hole is preferably six to eighteen inches, but may vary as desired, the system and tool allows for each pipe section to have a length of at least a few inches, such as at least four to seven and a half inches for an eight inch diameter vertical bore or sixteen inches for an eighteen inch diameter vertical bore. The longer sections in relation to the vertical bore hole diameter allow for faster boring.

The smaller size of the power unit designed in the system and tool combined with the mobile pipe rack design allow for two or more pipe insertion units to be installed inside the tool for simultaneous operation, supported by multiple pipe racks.

This would speed up the drilling system, tool and method, and would also allow for simultaneous pipe insertion in counteracting directions, offering a stable drilling tool.

In another embodiment, there is a method of boring transversely with respect to the first bore hole using the system and tool.

BRIEF DESCRIPTION OF THE DRAWINGS

FIG. 1B is a partial schematic view of a prior art horizontal drilling system;

FIG. 1C is a further partial schematic view of the lateral drilling system of FIG. 1A;

DESCRIPTION OF THE PREFERRED EMBODIMENT(S)

Figure 1A:
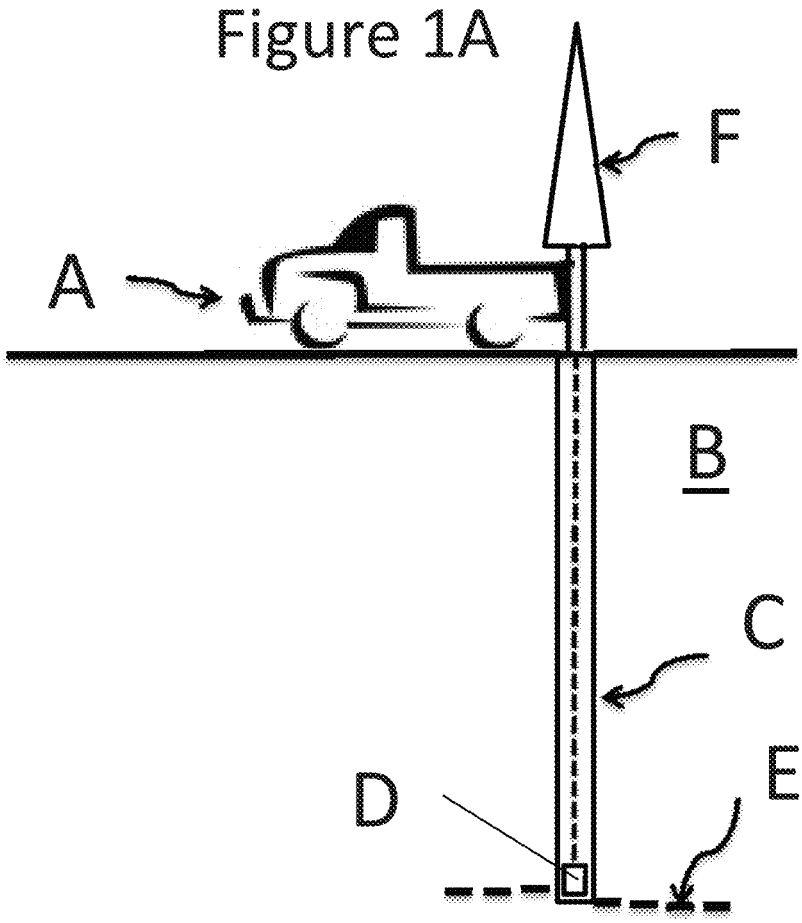
FIG. 1A is a partial schematic view of a lateral drilling system in accordance with a first embodiment of the invention.

As shown in FIG. 1A, in general, there is a set up or system for drilling vertical bore holes and lateral bore holes there from.

A drilling rig A includes a truck and a vertical drilling tool or rig F to create a vertical or substantially vertical bore hole C in ground B. In the vertical bore hole there is a radial drilling tool D for drilling transversely to the vertical bore hole, e.g., horizontally or substantially horizontally and to lay pipe segments or sections E extending in such transverse or horizontal direction, preferably normal to an axis of the vertical bore hole.

The vertical bore hole is initially drilled using conventional drilling methods. Lateral drilling is then conducted using the tool D inside the vertical bore hole. If the lateral drilling tool D is to be used for one-time access (e.g., for chemical injection or mechanical fracturing of the soil), then the tool D is inserted in the bore hole right after vertical drilling and thus pipe segment insertion may then begin.

If the tool D is intended to be used to install pipe segments for longer-term usage for fluid extraction or injection, then the installation of a casing is preferred. In the event a casing is to be used, a collapsible casing is inserted in the vertical bore hole prior to starting the operation of the lateral drilling tool. The collapsible casing is then expanded. The casing is sufficiently soft such that the initial pipe segment can pierce the casing to get outside the vertical bore hole and into the surrounding soil (the ground surrounding the vertical bore hole, which may be clay, silt, or other soil makeup, and may be heterogeneous).

To prepare for operation of tool D, the tool is loaded at a surface of ground B with a set of pipe segments to be inserted into the lateral bore hole as it is created.

FIG. 1B shows a prior art horizontal drilling system. As can be seen, in order to drill under a structure, one must drill a long shallow angled bore hole to a target area G, where remediation or other soil treatment is needed. In such a case, one needs access to the ground from a substantial distance from the structure under which the target area is located. Moreover, the horizontal drilling methods described in FIG. 1B typically need to use pressurized fluids, which sometimes escape to the surface of the ground. Further, this method is generally limited to one bore hole, because of the time and cost, and expense of the equipment, limited access, and other reasons. One must also have good aim when drilling so as to make sure to hit the target area. If one misses the target area, or is off center, the treatment may be very ineffective. In addition, if the target area has a large vertical depth, or if site conditions change in the ground, such as rising or decreasing groundwater depth, then one would likely have to bore multiple horizontal holes, greatly increasing time and expense.

FIG. 1C is a further schematic view of the lateral drilling system of FIG. 1A. As can be seen, by laterally drilling from a vertical bore hole, one can make much shorter bore holes, proximate the structure under which the target area is located. Moreover, one needs no pressurized drilling fluids. Multiple lateral runs E of pipe segments may be used to enter area G, the target area, achieving much better treatment of the target area, whether under a structure or not. In addition, the lateral drilling system of FIG. 1A allows for multiple orientations providing a wider coverage of the target area C than the single line of orientation of FIG. 1B.

Figure 2:
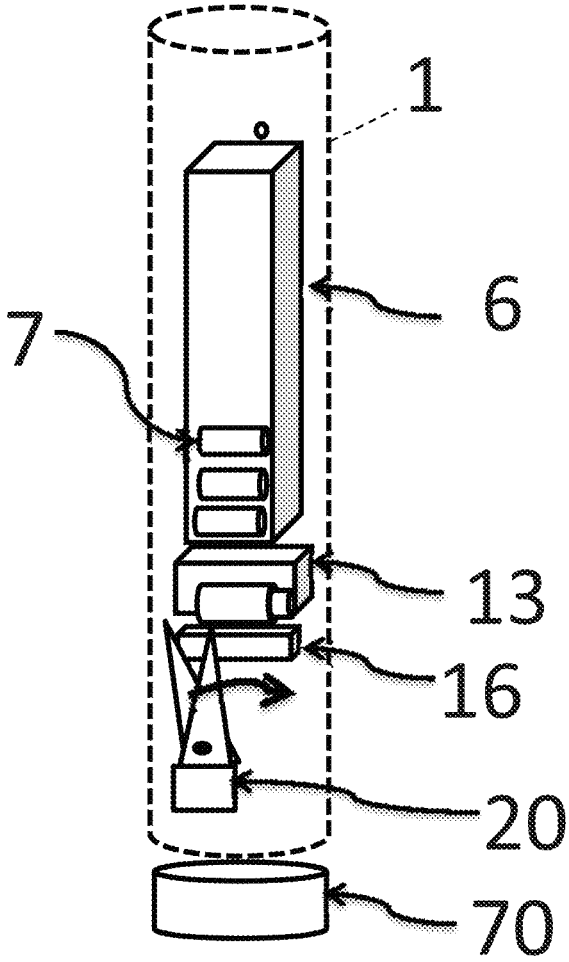
FIG. 2 is a partial schematic side view of the lateral drilling system of FIG. 1A showing additional details thereof.

FIG. 2 shows the main components of the system and tool. There is a rack 6 for holding pipe segments 7, and a pipe receiving and pipe launching section. The pipe receiving and pipe launching section contains a rack receiving unit 13, a pipe launching unit including a rail set 16 (dual rails) where pipe segments 7 are pushed laterally outward, and a power arm unit 20 for providing power for pushing the pipe segments. There is also an optional stabilizing plug 70 for stabilizing the tool's preferably cylindrical frame 1 in the vertical bore hole.

Tool frame 1 is sized in diameter to fit inside the vertical bore hole such that the tool frame can be moved up and down with respect to the vertical bore hole. Therefore, an outer diameter of tool frame 1 is ideally just slightly smaller than an inner diameter of the vertical bore hole. Tool frame 1 may be a lot smaller than the diameter of the vertical bore hole, but then the pipe segments must be shorter. To have pipe segments of maximum length given the vertical bore hole, tool frame 1 must be just slightly smaller than the vertical bore hole diameter.

The pipe launching unit, pipe rack receiving unit 13, and power arm unit 20 and optional stabilizing plug 70 are preferably affixed to tool frame 1.

Lateral Drilling System and Tool Components and Interaction Thereof

Figure 3:
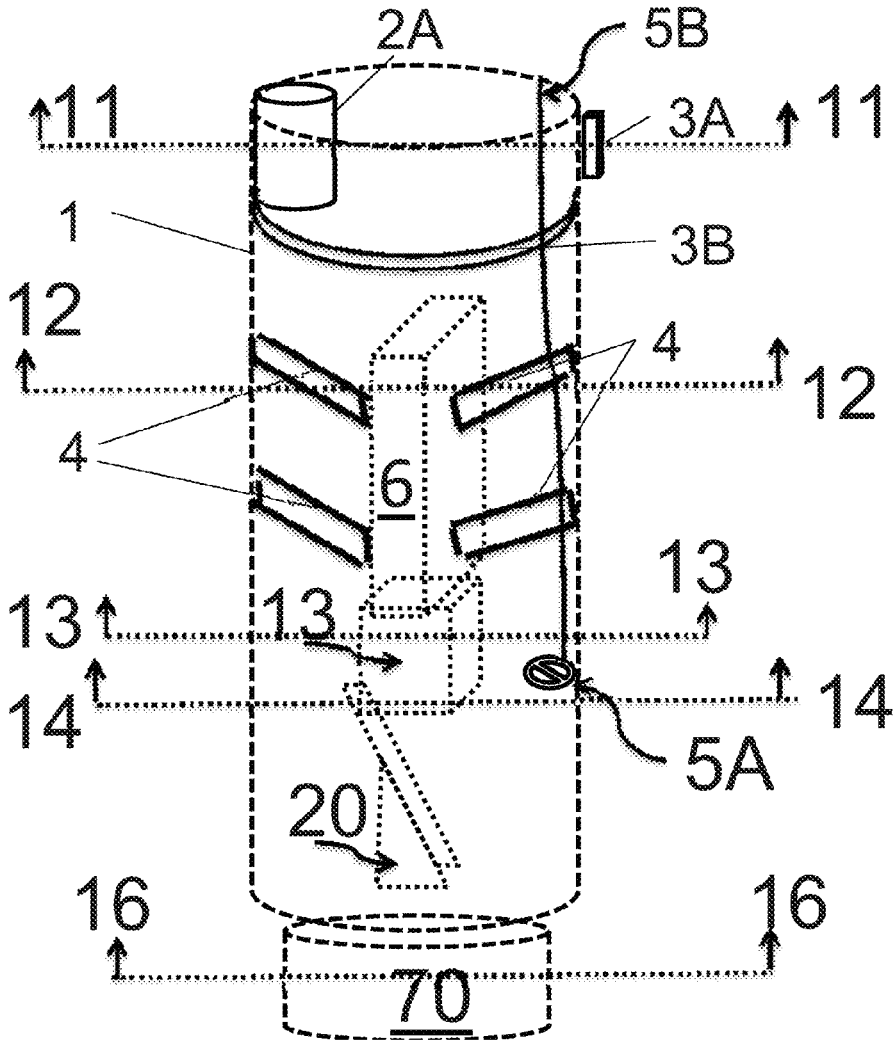
FIG. 3 is a partial schematic enlarged view of a frame and certain working parts of a tool of the lateral drilling system of FIG. 1A.
Figure 11:
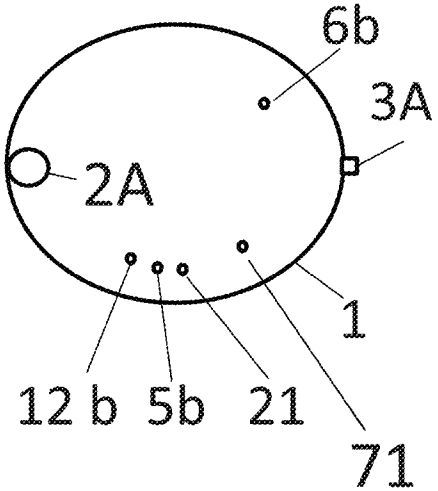
FIG. 11 shows a plan view of the system taken along a line 11-11 of FIG. 3.
Figure 12:
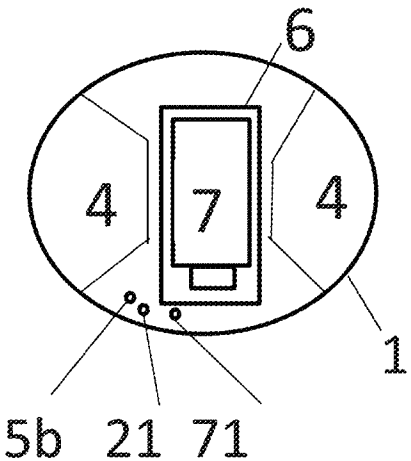
FIG. 12 shows a plan view of the system taken along a line 12-12 of FIG. 3.
Figure 13:
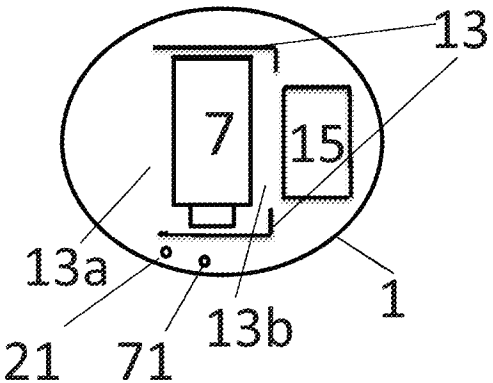
FIG. 13 shows a plan view of the system taken along a line 13-13 of FIG. 3.

FIG. 3 shows a partial schematic side view of tool frame 1 and tool components. FIGS. 11 *through* 14 and 16 show partial sectional views taken along lines 11-11 through 14-14, and 16-16, respectively.

As noted above, tool frame 1 holds rack receiving unit 13 and the pipe launching unit including power unit 20, dual rails 16 (shown in FIGS. 6A and 6B) and also optional stabilizing plug 70. The power unit 20 is preferably hydraulic. It may also be pneumatic, electric, or sonic. Tool frame 1 is typically six inches to about one and a half feet in diameter and three to ten feet long, or about in these ranges. "About" here means within plus or minus thirty percent. However, in other embodiments, the dimensions of the frame may be outside of these ranges, as needed depending on various factors, such as the diameter of the vertical bore hole, the depth of the vertical bore hole, the desired lateral pipe segment dimensions, the desired vertical and/or horizontal plane spacing of lateral runs of pipe segments, the amount of power needed, etc.

Threaded tubing 2 to orient and hold tool frame 1 (FIG. 11) mates with a female threaded pipe receptacle 2A (FIG. 3) which is fixed to tool frame 1. Threaded tubing 2 preferably extends sufficiently to go above the surface of ground B. The sections of threaded tubing 2 may be marked with a continuous longitudinal ridge to serve as a registration mark for the orientation of the tool down hole.

A rigid member 3A is preferably of a metal such as steel and is for fitting into a groove of a vertical drilling casing or hollow stem auger's lowest auger segment, to join the tool and the vertical casing for orientation. The lowest portion of the hollow stem auger used to drill the vertical bore hole can be equipped with a female notch to allow mating of steel piece 3A to the hollow stem. The auger would be part of the drilling rig F.

A circular frame structure(s) 3B preferably narrowly fit(s) within the hollow-stem auger of the vertically drilled bore hole or the bore hole soil wall and is (are) designed to maintain centering of the pipe inserting tool and provide steady contact with the vertical well casing and create leverage during lateral launching of pipe segments to steady the pipe pushing unit.

Funnel-shaped guides 4 fixed to tool frame 1 help orient rack 6 when it is being lowered and help maintain the pipe rack in place.

A video camera 5A and video cable 5B may be used and connected to video monitoring equipment at the surface for observation of down-hole operations.

Figure 4:
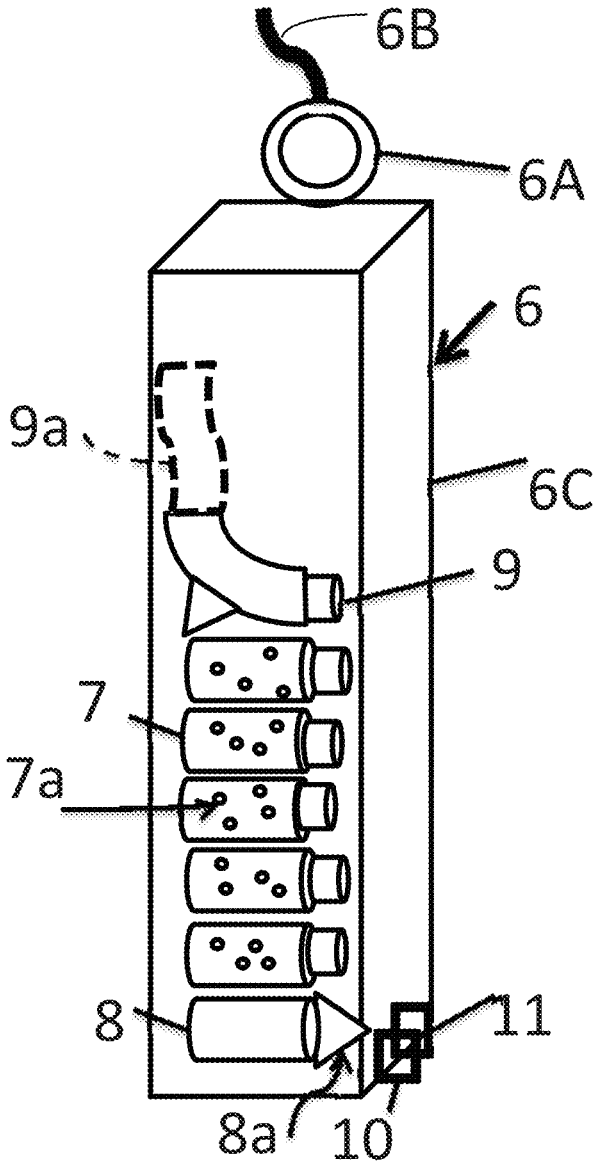
FIG. 4 is a schematic enlarged perspective view of a pipe loading rack and pipe sections of the tool of the lateral drilling system of FIG. 1A.

As shown in FIG. 4, rack 6 has multiple pipe segments 7 in a stacked array. The pipe rack has a preferably rectangular frame 6C which preferably is rectangular and contains ribs or grooves on its inside to ensure alignment of pipe segments 7. Rack frame 6C may also be equipped with a spring or other resilient device extending from a top of the rack down inside the rack to gradually push the pipe segments downward to aid gravity, or gravity alone may be used. As explained in more detail below, following launch of one pipe segment, a next pipe segment drops down to the bottom of the pipe rack and is ready to be moved into the launching position.

A hook 6A and a cable 6B hold rack 6 while it is lowered to or raised from the rack-receiving unit 13.

Pipe segments 7 are initially inserted successively into the rack, and then the rack is lowered into the vertical (first) bore hole, and then the pipe segments are launched laterally. Each pipe segment has a leading end with a short smaller-diameter male part made to be inserted into a female part at a back or trailing end of the preceding pipe segment. The male end (or female end or both) may also contain an O-ring in a groove to ensure a snug fit and tight contact between the pipe segments. Such a snug fit enables fluid or liquid or fine materials that are being injected into and/or removed from the target area to flow without leakage. The pipe segments may have solid walls, or may contain slits, holes 7*a*, louvers or other openings to allow for fluid flow into or out of the pipe segments. The pipe segments may be cylindrical, or may also have a hexagonal or other cross-sectional shape.

The very first or initial pipe segment 8 has a tip 8*a* designed for boring or opening a lateral bore hole. Tip 8*a* is designed to force the pipe segment 8 through the soil, making an opening in the soil as it is being pushed by the pipe launching unit.

Tip 8*a* will typically be conical in shape, but several detailed designs including wedges and teeth or screw-shaped grooves may be used to facilitate the boring process. A diameter of initial pipe segment 8 or tip 8*a* may be the same as or larger than subsequent pipe segments 7 (and last pipe or hose segment 9) to allow for a partial void in the rock/soil surrounding the pipe, thereby enhancing fluid flow out of and/or into the pipe segments. The pipe segments can be made of metal, PVC or other suitable material.

Last pipe segment 9 for a laterally drilled pipe is preferably of a different design, with a curved or threaded or ribbed end segment to allow for connection of such end of the pipe to a hose 9*a* or other conduit. The last pipe segment of each laterally drilled conduit can also be constructed to include a larger diameter to offer a rivet-like element 54 in case a casing 34 is used to rivet the last pipe segment 9 to the casing 34. (See FIGS. 9 and 10).

A latch mechanism 10 that extends inward to hold up the stack of pipe segments until the rack is lowered onto the rack receiving unit 13. As rack 6 is seated on the rack receiving unit, the latching mechanism opens and the pipe segments are allowed to drop by gravity down one by one to the bottom of the rack. Two or more latch mechanisms may be affixed to the rack.

Figure 5A:
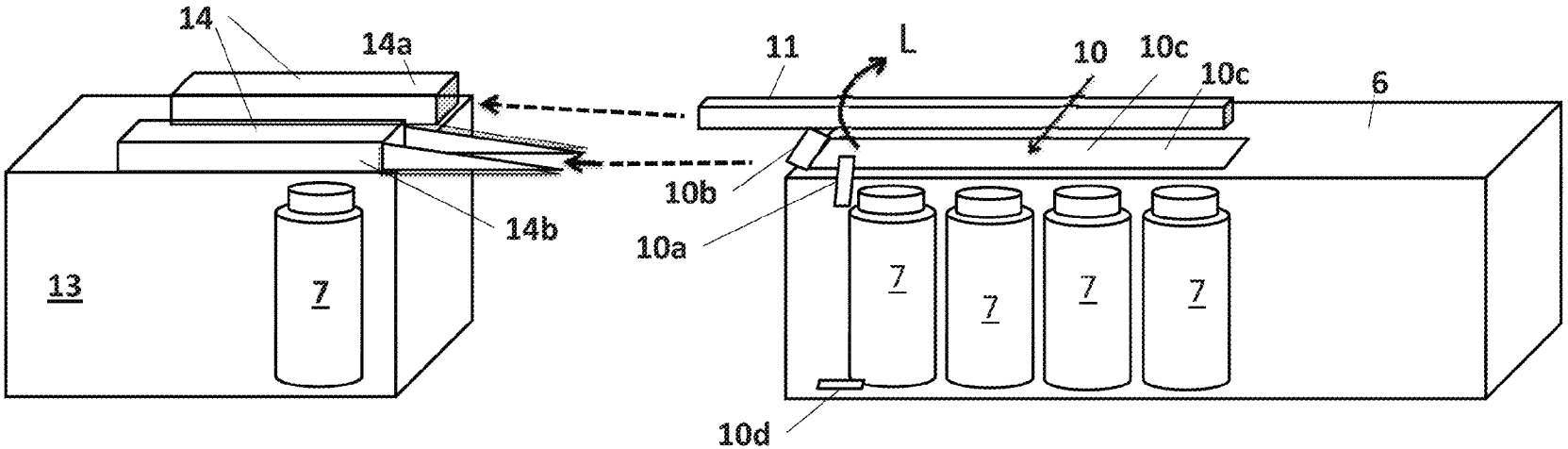
FIG. 5A is an enlarged partial schematic view of latches for joining the rack and a pipe receiving unit of the lateral drilling system of FIG. 1A, the rack and pipe receiving unit being shown in a horizontal orientation for purposes of illustration.
Figure 5B:
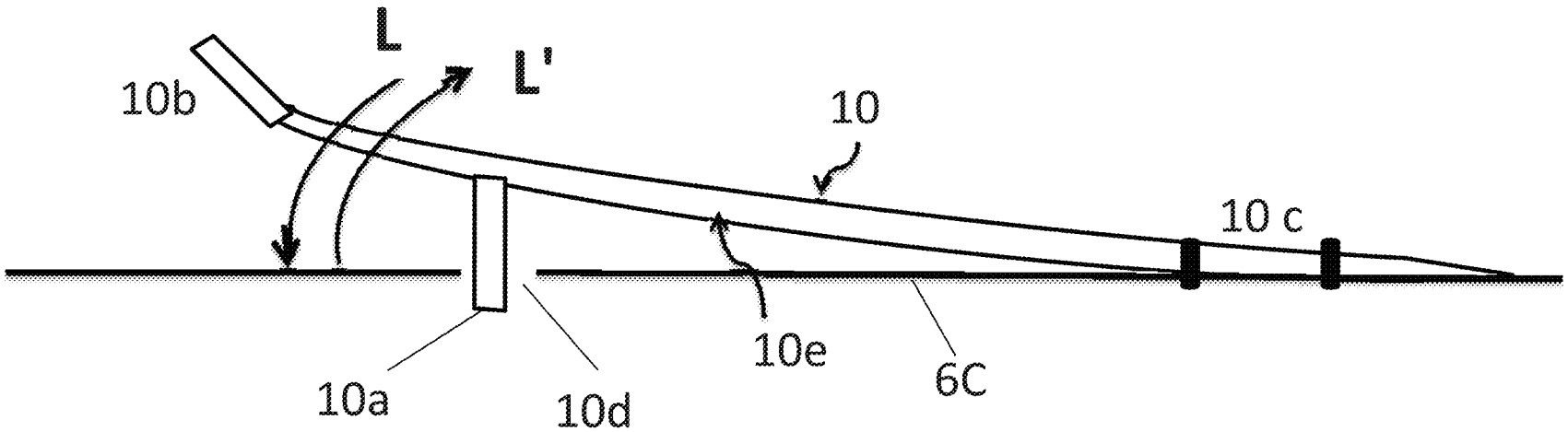
FIG. 5B is an enlarged view of a portion of the pipe loading rack of FIG. 5A in the same orientation as in FIG. 5A.

As shown in FIGS. 5A and 5B, each latch mechanism 10 has a flexible tongue 10*e* fastened at its upper end to rack 6 by screws or fasteners 10*c*. The latch mechanism includes a tab 10*a* extending to the inside of rack 6 by passing through a hole 10*d* in side wall 6C of rack 6 at the lower edge of a lowest pipe segment 7, preventing pipe segments 7 from dropping or falling downwards. Each latch mechanism 10 also includes a beveled portion 10*b* designed to meet an angled front, upper end of the latch opening mechanism 14 affixed on rack receiving unit 13. The latch mechanism 10 has a flexible tongue 10*e* designed to be contacting the rack 6 in a rest position (shown in FIG. 5A), and to be pushed out (arrow L') from the stack of pipe segments while rack 6 rests on rack receiving unit 13 (shown in FIG. 5B). When the rack is lifted away, the flexible tongue 10*e* slides off the beveled edges of the latch opening mechanism 14 and returns elastically to the rest position on rack 6, forcing tab 10*a* back through the opening in the rack's wall 6C.

A bar 11 assures alignment of rack frame 6 to rack receiving unit 13. Bar 11 may include a groove or grooves and a tongue shaped metal or plastic parts to ensure proper positioning of the rack frame on the rack receiving unit's latch opening mechanism 14.

Figure 6A:
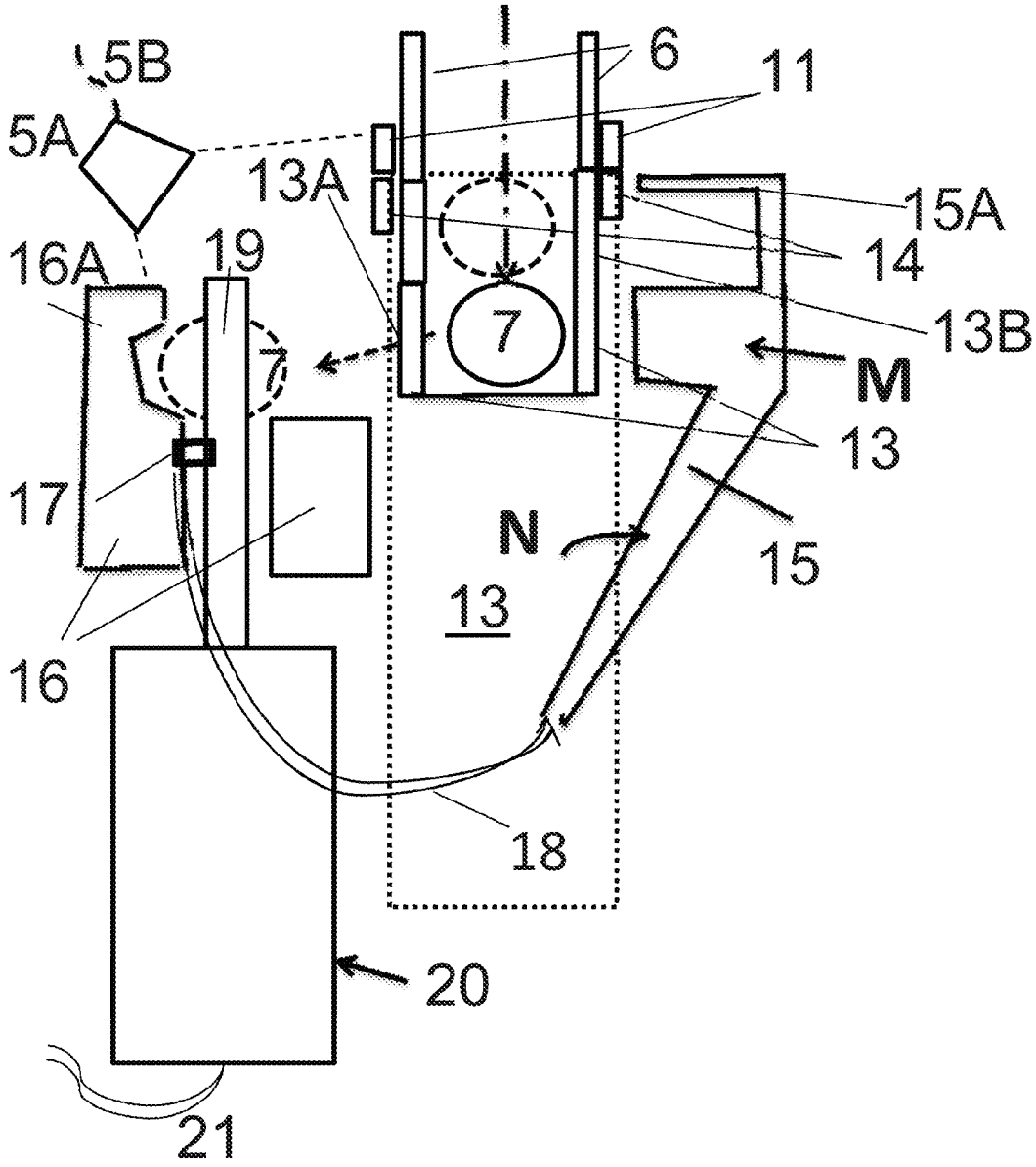
FIG. 6A is a partial schematic side and enlarged view of the rack receiving and pipe launching section of the lateral drilling system of FIG. 1A.
Figure 6B:
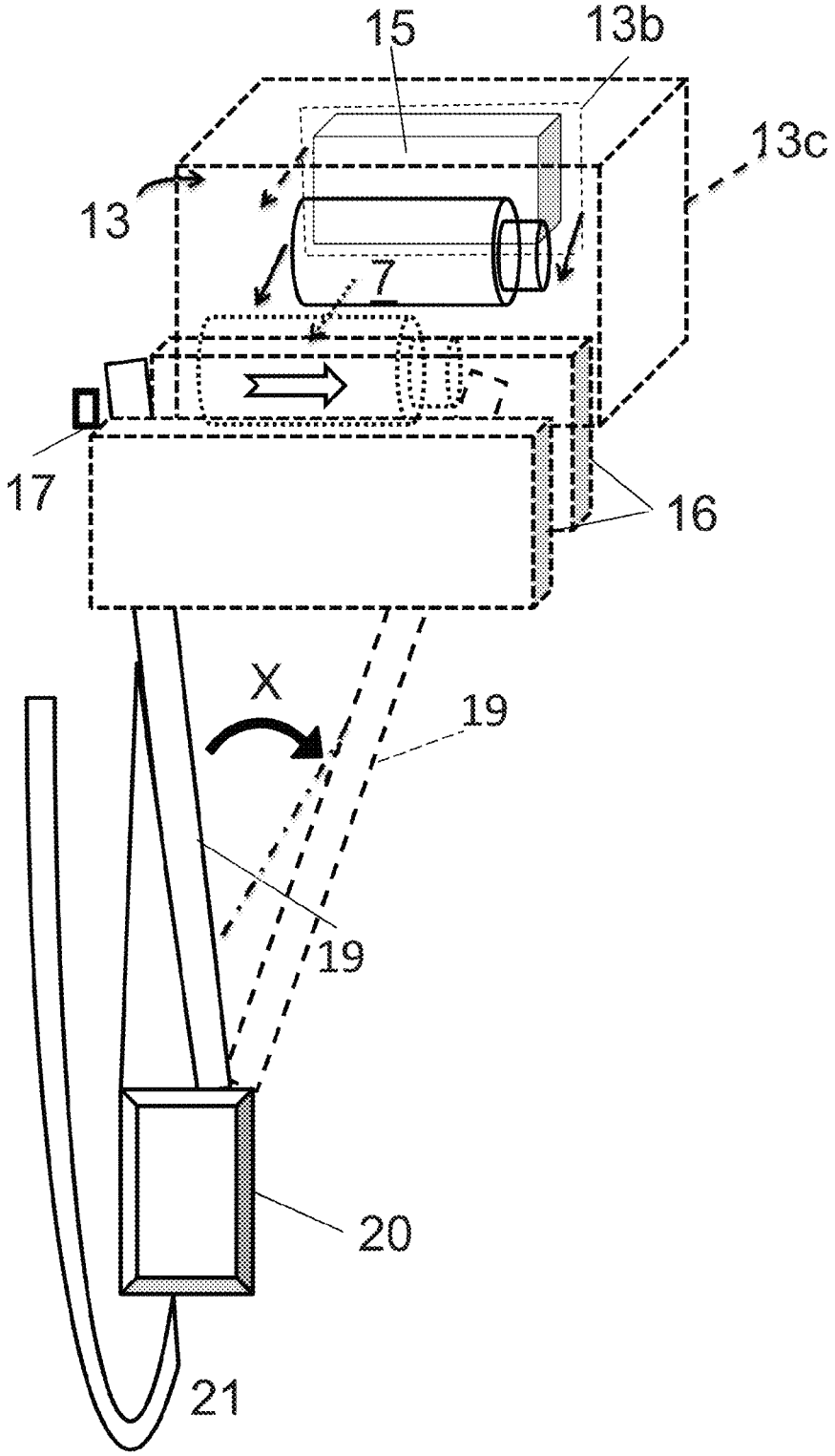
FIG. 6B is a partial schematic front and enlarged view of the rack receiving and pipe launching section of the lateral drilling system of FIG. 1A, showing a pipe loading position in solid and a pipe launching position in phantom, and omitting a vertically extending section for the sake of clarity.

As shown in FIGS. 6A (side view) and 6B (front view), there are details of the rack receiving and pipe launching section. Pipe receiving unit 13 is anchored to tool frame 1 and shaped complementary to rack frame 6 to receive it. One face of the upper part of the pipe receiving unit 13 has an opening 13A to allow for lateral exit of a pipe segment 7. The opposite face of pipe receiving unit 13 also has an opening 13B to allow a hammer device 15 to enter rack 6 and push the lowermost pipe segment through opening 13A onto dual rails 16 and thus into a launching position.

Latch opening mechanism 14 connecting to rack 6 mate with the rack's latch mechanism 10 and bar 11 as explained above, ensuring tight contact between rack frame 6C and pipe launching unit 13C. (See also, FIG. 5A) The latch opening mechanism 14 includes a hollow member 14*a* designed to mate with bar 11, and a projecting member 14*b*, which has beveled and pointed edges designed to slide under beveled portion 10*b*, and thus force flexible tongue 10*e* in the direction of arrow L' (away from rack 6). This action moves tab 10*a* in a direction L (FIG. 5A) away from the pipe segments, enabling the lowermost pipe segment 7 to be ready to be moved into the launching position.

Hammer device 15 (similar to a bicycle gear-shifting, cable-controlled device, or other device) is for pushing the lowermost pipe segment 7, 8 or 9 in a direction M out of rack 6 and into the launching position as best shown in FIG. 6A. While extended to push the pipe segment out, the hammer device has an upper, horizontal plate 15A that holds up the pipe segments stacked above in rack 6.

After pushing the lowermost pipe segment into the launching position, the hammer device 15 is controlled to move in the direction of arrow N. This vacates the space under the stack of pipes, and allows the next pipe segment 7 (or last pipe segment 9 or initial pipe segment 8) to drop down to the lowermost position in the rack. The hammer device 15 is biased in the direction of arrow M to the rest position of FIG. 6B by an internal spring similar to a bicycle derailleur in the default position. Activation of the hammer device triggers the hammer device to extend outwards in the direction of arrow N, allow a pipe segment to drop, and then the hammer retracts in direction M to its rest position, simultaneously pushing out the pipe segment. A trigger switch 17 triggers movement of hammer device 15 in the direction of arrow N. This trigger switch can be a pressure sensing device, or a mechanical lever that moves a cable connected to hammer device 15. When a pushing arm 19 of the power unit 20 returns to its pre-pushing position (shown in FIG. 6A, and also shown in solid lines in FIG. 6B), trigger switch 17 activates the hammer device 15 to extend outwards, so the hammer device is responsive to return of the pushing arm 19 to the pre-pushing (or "ready") position.

As the pipe pushing arm 19 is moving (e.g., rotating) away from the trigger switch 17, the hammer device remains in position under the stack of pipe segments.

A cable 18 is for transferring a command from trigger switch 17 to hammer-like device 15. This cable can consist of a metal cable in a sheath, electrical cable or hydraulic or pneumatic signal hose.

If the pipe insertion and/or the hammer device 15 are actuated manually for each segment from the surface aided by down hole video monitoring rather than using trigger switch 17, the trigger switch and cable 18 may be omitted.

In more detail, horizontal plate 15A attached to hammer device 15 swings with the hammer device and acts as a bottom plate to hold up the stack of pipe segments and prevent pipe segments from dropping down. When the hammer device moves away from the rack, the stack of pipes is free to drop down by gravity. When the hammer device returns to its rest position, horizontal plate 15A is again pushed between the next pipe segment to become the lowest pipe segment and the pipe segment just above that, holding the stack of pipe segments above horizontal plate 15A.

Rail set 16 (dual rails) supports the pipe segment in the launching position. This rail set 16 is anchored to tool frame 1 and is parallel to the pipe receiving unit 13 but at a lower relative elevation. The rail set is grooved to allow movement of a shuttling block 19A. The shuttling block 19A (FIGS. 14 and 15) acts as a cushion between pushing arm 19 and the trailing end of pipe segment 7, and may incorporated as part of pushing arm 19 or a separate element. Because the pushing arm 19 rotates, to translate force in the axial direction of the pipe segment and provide substantial surface area for such translation, the shuttling block 19A is used. The shuttling block 19A follows grooves in the rail set to maintain the proper launch trajectory of the pipe segment being pushed. After pushing arm 19 goes from its initial or ready position and reaches its maximum forward position or final position, then preferably pushing arm 19 is automatically retracted back to its ready position.

An upper portion 16A of one of the dual rails 16 remote from hammer device 15 provides a higher, partially ridged wall, as shown in FIG. 6A. Upper portion 16A has an overhanging surface sloped to provide a substantially semi-cylindrical launching receptacle to ensure the proper launch trajectory of the pipe segments.

In more detail, pushing arm 19 is affixed to a mobile half of power unit 20, and exerts force on the trailing end of the pipe segment (via the shuttling block), which pipe segment is in the launch position to push the pipe segment into the soil. The arm is powered by power unit 20, and can be a single arm if the shuttling block 19A is pushed from one central point, or can be a forked arm to push the shuttling block from two sides. The free end of the pushing arm 19 moves in a substantial axial direction of the pipe segment in the launching direction by virtue of rotating the arm in the direction of arrow X in FIG. 6B.

Figure 15:
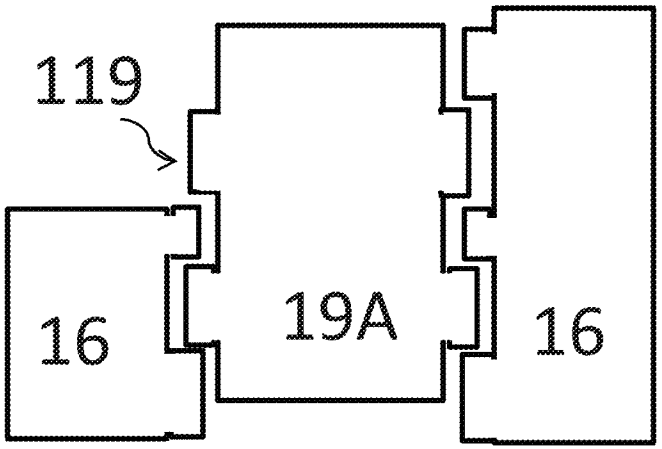
FIG. 15 shows is a sectional view taken along a line 15-15 of FIG. 14, showing detail of a shuttling block and dual rails.
Figure 14:
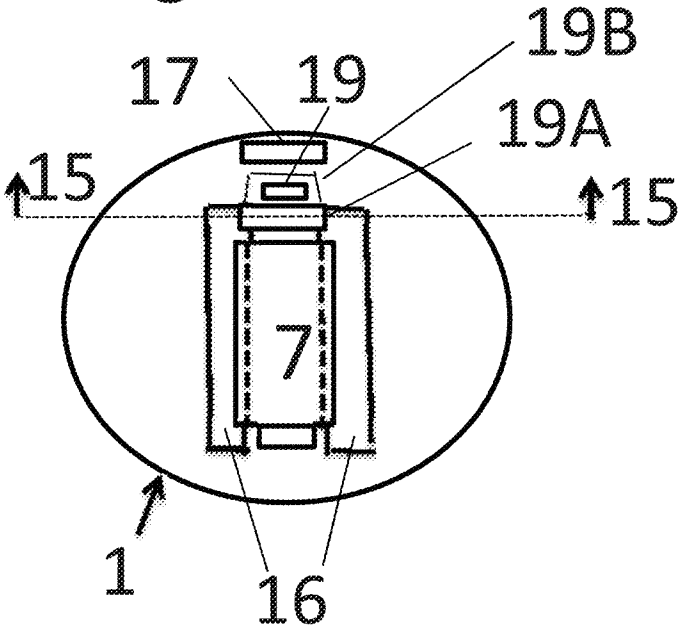
FIG. 14 shows a plan view of the system taken along a line 14-14 of FIG. 3.

As shown in FIGS. 14 and 15, shuttling block 19A is built with a ridged outer surface 119 on each side to fit into grooves in dual rails 16. The shuttling block is also equipped with a back brace 19B that encircles pushing arm 19 to ensure that the shuttling block is moved back along with the pivoting arm after a pipe segment is launched. This shuttling block is pushed by the pushing arm 19. Back brace 19B is preferably a strap tied to shuttling block 19A.

Power unit 20 provides the power for moving (e.g., rotating) pushing arm 19. This may be a hydraulically powered jaw, such as used in automotive body repair operations, or pneumatic or electric motor, or sonic. When embodied as a double jaw unit, power unit 20 may include one stable jaw affixed to the tool frame 1 and another jaw on which is affixed the pushing arm 19. The power unit receives power from the ground surface via a power supply hose 21.

The use of a jaw enables a long launch stroke in relation to the diameter of the first bore hole, enabling pipe sections that have a length greater than a radius of the first bore hole, and preferably seventy percent up to about ninety or ninety five percent of the diameter of the first bore hole.

The system, tool and method preferably also makes use of a video camera 5A and video cable 5B attached to the frame 1 in a position for observation of pipe loading and pipe launching operations. (See, e.g., FIG. 6A)

Figure 7:
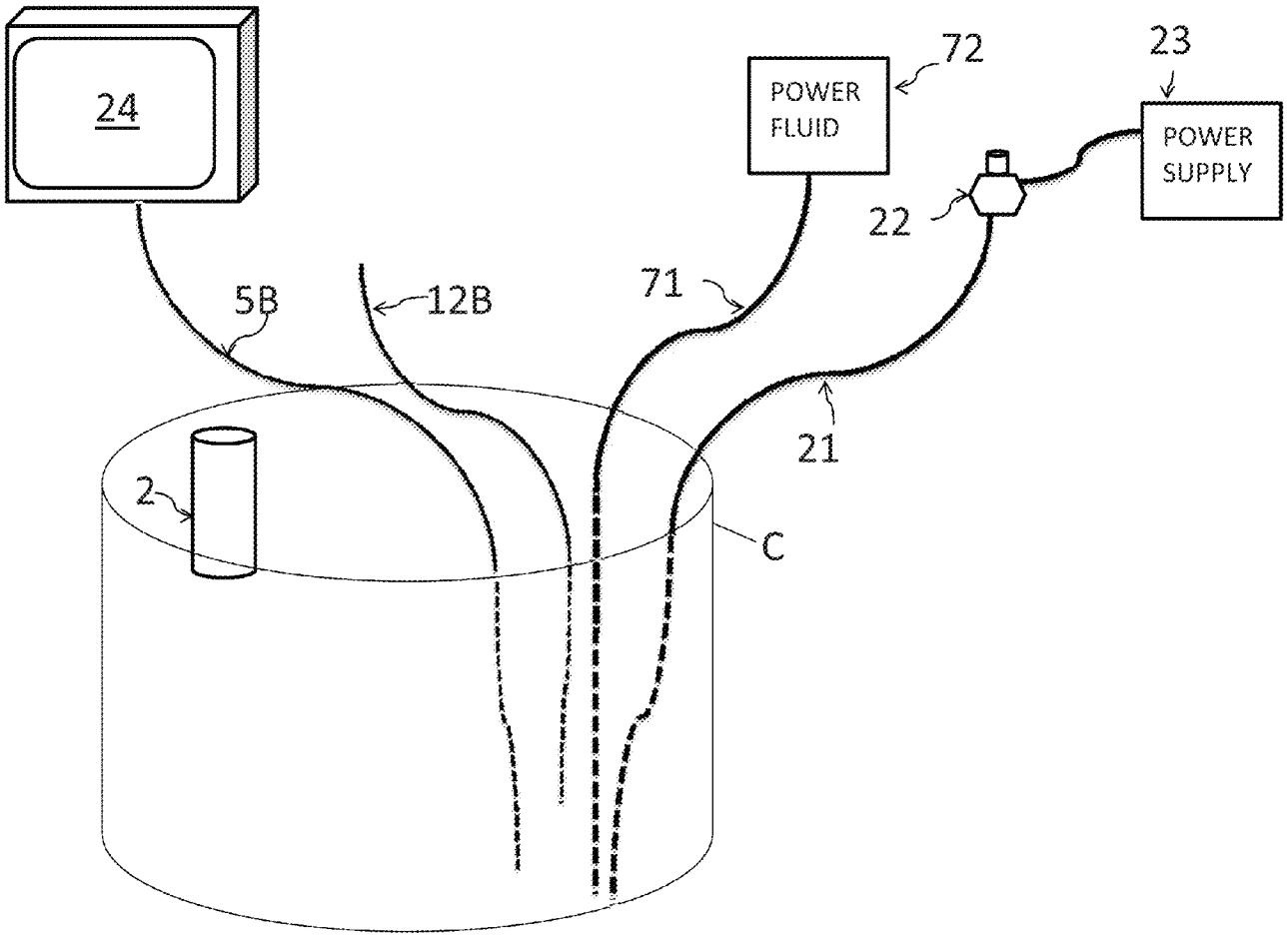
FIG. 7 is a partial schematic view of equipment located at the surface proximate a bore hole for use in the system of FIG. 1.

FIG. 7 shows various surface equipment components. An activation switch 22 activates the power unit of the lateral drilling tool and triggers movement of pushing arm 19. This switch can be activated manually when pipe insertion is activated manually based on video observations or can also be incorporated into an electric or pneumatic or other system to allow for rapid successive pipe insertions.

A power supply unit 23, such as an electrical, hydraulic, sonic or pneumatic power supply unit, is also preferably located at the surface. In addition, a video monitor 24 for observations of water wells or bore holes may be at the surface.

Drillable Expandable Casing and Deployment Tool

Figure 8:
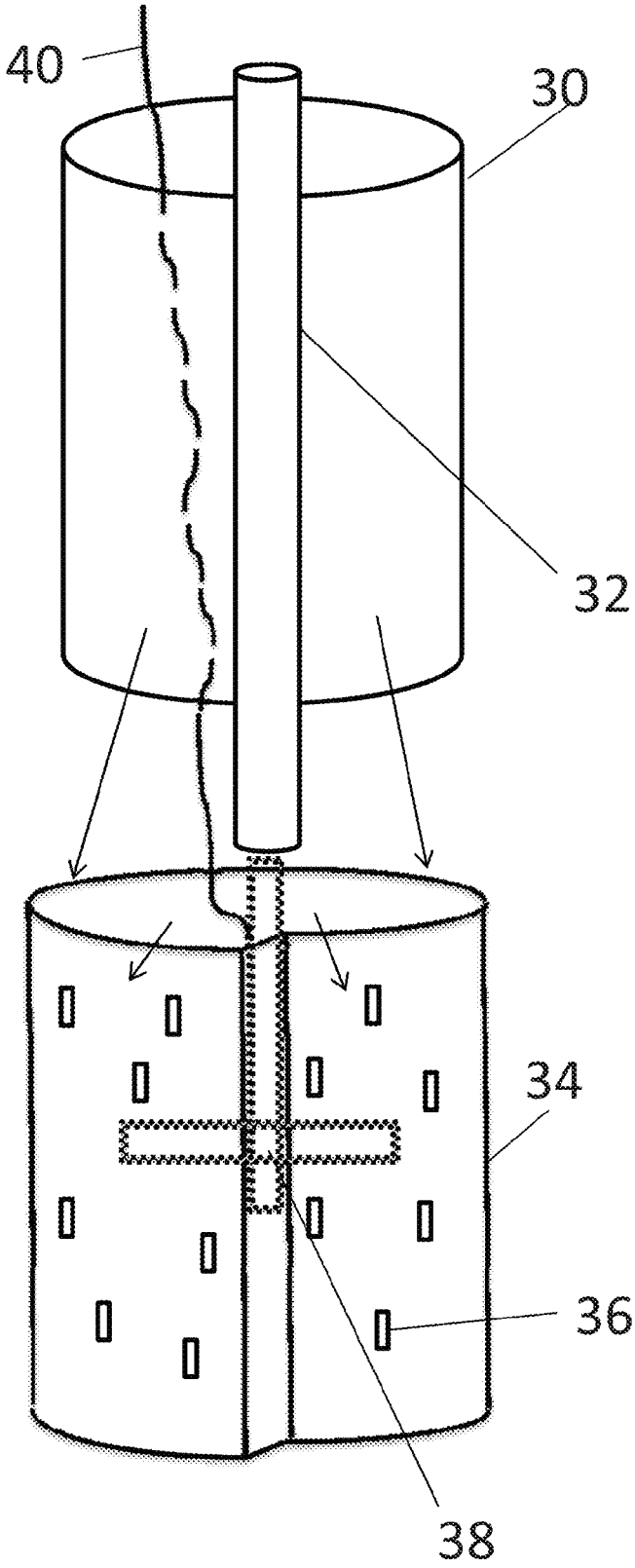
FIG. 8 is a side view of an expandable and collapsible casing and a deployment tool for use with the system of FIG. 1.
Figure 8A:
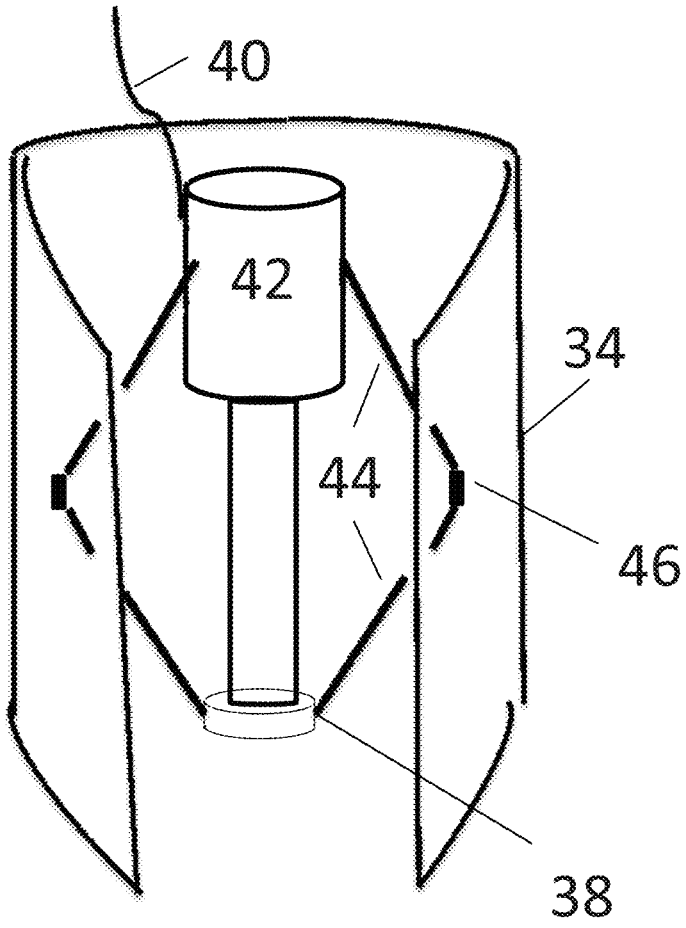
FIG. 8A is a side view of the casing and details of the deployment tool for use with the system of FIG. 1.
Figure 8B:
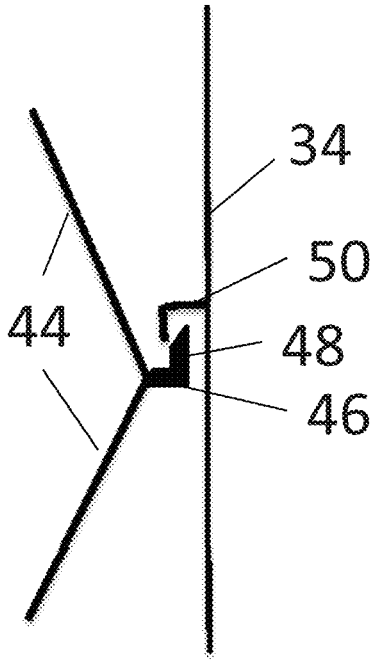
FIG. 8B is a side view of part of the collapsible casing and details of the deployment tool for use with the system of FIG. 1, including detail of a support and release hook.

With reference to FIGS. 8, 8A and 8B, if the lateral drilling is for a one-time subsurface operation, such as fracturing of the soil, or injection of chemicals, then a casing need not be used. A casing 34 may be used when the pipe segments are planned to be used after lateral drilling such as for fluid extraction from and/or injection into the surrounding soil or rock. The casing is designed to provide a protective surface material against the ground's vertical surface in the vertical bore hole to maintain the integrity of the hole. This casing keeps the soil and any rock from falling into the bore hole during and after lateral drilling. The casing is preferably a material that is soft enough to be penetrated by the lateral drilling tool, yet strong enough to maintain the integrity of the vertical bore hole.

A hollow stem auger 30 (or other casing for vertical drilling or a bare bore hole) is shown in FIG. 8. The casing 34 is expandable and collapsible, and is inserted inside and through the hollow stem auger 30.

A standard drill pipe 32 or threaded tubing holds casing 34 in a collapsed state and also holds a casing deployment tool. Drill pipe 32 is activated from the surface, similar to the operation and connection of threaded tubing 2.

Expandable/collapsible casing 34 is foldable or collapsible to fit into an overall cross-sectional dimension smaller than the inner diameter of the hollow stem auger or casing 30 and then expand to a larger diameter. Casing 34 can be made of soft metal, rubber, or other material or combination of materials. Casing 34 is designed to provide protection from excessive well bore collapse, and to provide relatively small resistance to the pipe-punching operation. Casing 34 can also be a partially accordion-shaped metal material.

Optional slits 36 (slits, holes, louvers or other openings) are preferably formed in casing 34 to allow flow of fluids through the casing, although casing 3 may be a blank material.

Specifically with reference to FIGS. 8A and 8B, deployment details of collapsible casing 34 including a connection and release mechanism are shown. An expansion and release grip unit 38 includes a central base unit 42 to which movable arms 44 are attached. The expansion and release unit 38 operates in a manner similar to collapsible umbrella canes. Hooks 46 serve to hold casing 34 which may also be released there from.

A power line 40 for the expansion and release grip unit 38 is an electric, hydraulic, pneumatic or mechanical line, or a conduit allowing for operation and triggering of the unit 38 from the surface. There is an extendable hydraulic, pneumatic or electric jack 42 for actuating movable arms 44 (e.g., rotatable arms) for supporting the casing 34. There is also a support and release hook 46 between movable arms 44 and the casing.

The support and release hook 46 includes hooks 48 at junctions of movable arms 44 and support 50 affixed to the casing. By expanding casing 34 and then lowering the expansion and release grip unit 38, the hooks 48 slide off or out from under the support 50 of casing 34, allowing the casing to remain in place. The casing is then left in the vertical bore hole to provide support. Support 50 has a downward facing opening and is affixed to the inside of casing 34 and rests on hooks 48 during the lowering, expanding and releasing of the casing.

Figure 9:
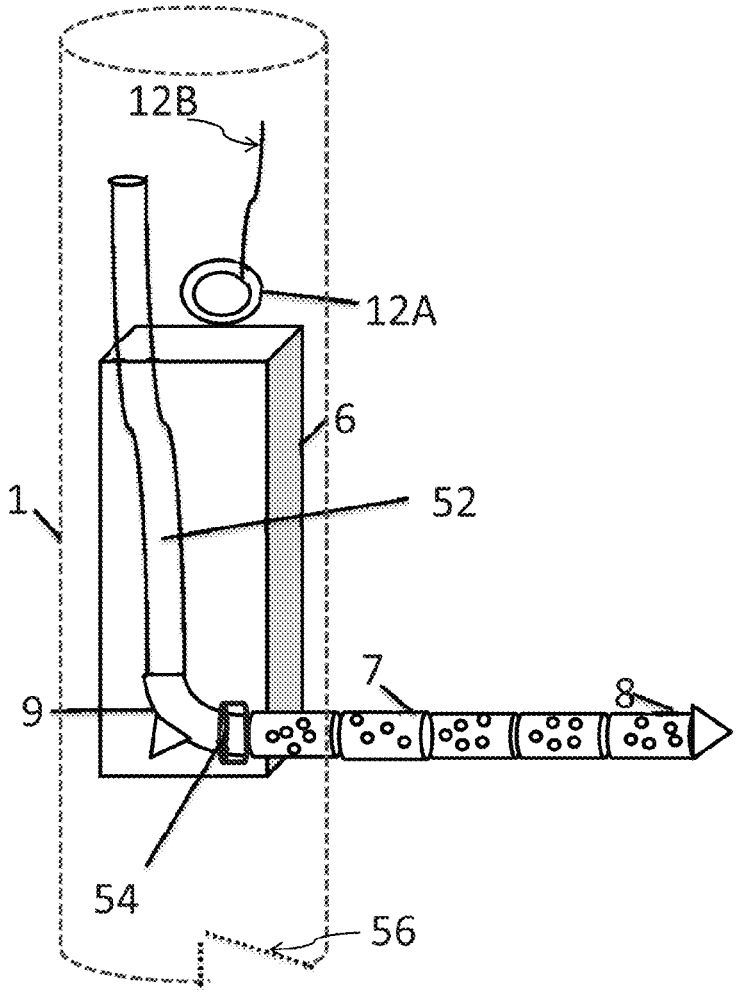
FIG. 9 shows an optional hose connection to lateral pipe sections.
Figure 10:
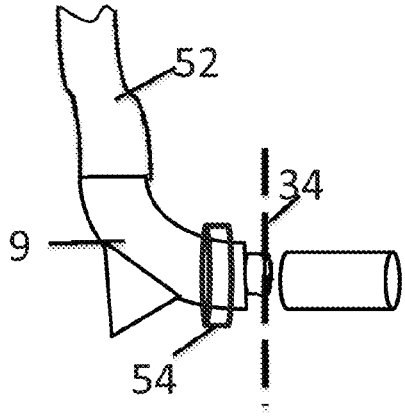
FIG. 10 shows details of the hose connection of FIG. 9.

FIG. 9 shows an optional hose 52 for connection to last pipe segment 9 by a threaded connector or hose clamp or other tight fit. Hose 52 also is connected at the surface for communication with a treatment fluid for injection into the soil/rock or for fluid extraction from the lateral pipe segments (forming a lateral conduit) installed using the lateral drilling system, tool and method in accordance with a preferred embodiment of the invention.

Last pipe segment 9 or any pipe segment 7 can be built with a larger-diameter rivet element 54 designed to contact casing 34 to help in maintaining the casing in place. A gap 56 in a lower part of tool frame 1 allows the tool frame to be lowered while leaving hose 52 in place connected to last pipe segment 9. In some embodiments, pipe segment 9 might not actually fit in the rack 6, and either would be manually loaded or the rack 6 may be modified to accommodate last pipe segment 9.

Figure 17:
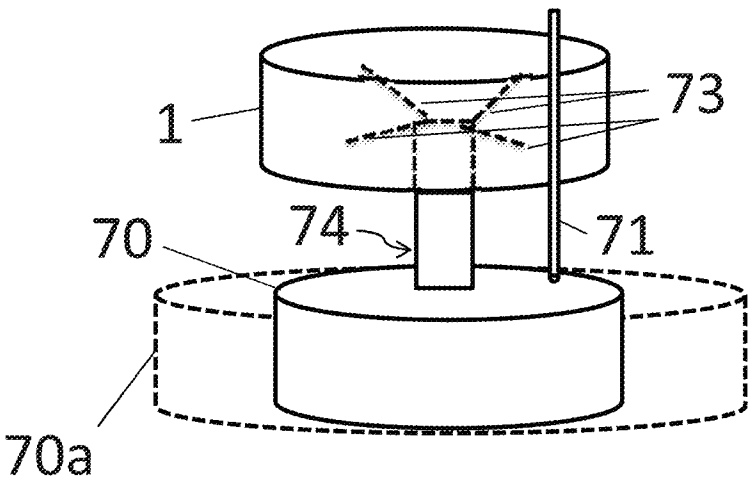
FIG. 17 shows a partial schematic side view of the stabilizing plug of FIG. 16 showing a deflated position in solid line and an inflated position in broken lines.
Figure 16:
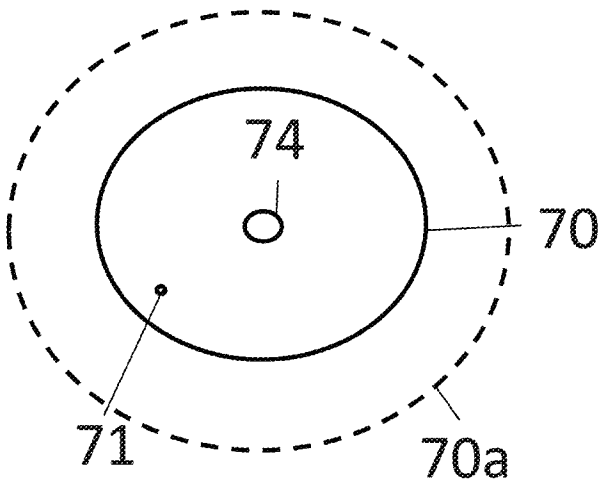
FIG. 16 shows a plan view of the system taken along a line 16-16 of FIG. 3 of a stabilizing plug showing a deflated position in solid line and an inflated position thereof in broken lines.

With reference to FIGS. 16 and 17, there is shown in more detail a stabilizing plug 70. Plug 70 is similar to commonly used inflatable plugs in the plumbing and oil industry. Plug 70 is inflatable, and may be formed by a rubber donut-shaped device, and then affixed to a rod 74. Rod 74 is preferably centrally located and made of a rigid material such as steel.

In operation, the plug is inflated and deflated through inflow or outflow of air or hydraulic fluid through a hose 71 connected at the surface to a power fluid unit 72 that is of a hydraulic or pneumatic fluid pressure unit. (See also FIG. 7). The pressure in power fluid unit 72 controls the expansion or collapsing of the stabilizing plug. Centralizing braces 73 located at the center of the base of tool frame 1 join tool frame 1 with rod 74 for holding the stabilizing plug.

Note that more than one stabilizing plug may be used, and that the use of the stabilizing plug may limit the ability to install pipe segments and the installation of hose 52 since sufficient spacing would be required during lifting of the lateral drilling tool.

Drilling Method

First, a vertical bore hole is drilled, e.g., conventionally using a drilling rig with an auger or bucket or other vertical drilling method. Prior to beginning lateral drilling, the vertical bore hole to be drilled may be lined with casing 34 as discussed above.

Then, at the surface, the lateral drilling tool is readied. Pipe sections 8, 7 and 9 can be pre-loaded in the pipe rack 6 and pipe rack 6 inserted in the tool frame 1.

Stabilizing plug 70, power arm unit 20 and a video camera are connected to units power fluid unit 72, power supply unit 23, and video monitor 24, respectively.

The tool is then lowered into the bore hole by successive segments of threaded tubing 2 to a target depth corresponding to the target area, and tool frame 1 is set to mate with a casing at the bottom of casing 34 or a hollow stem auger using notch 3A or simply lowered into an uncased bore hole, and a lower portion of the tool frame is then circumferentially oriented to start lateral launching of pipe segments.

When the tool frame is at the desired launch orientation, stabilizing plug 70 is inflated by power fluid unit 72. Pipe launching can now start by activation of power unit 22. Down hole, pushing arm 19 is triggered to separate from the jaw portion affixed to tool frame 1. Upon pushing arm 19 returning to its starting position (fully retracted), trigger switch 17 is activated, and hammer device 15 moves to push initial pipe segment 8 into the launch position. Pushing arm 19 is then activated to push the initial pipe segment through the casing 34 (or through a bare wall of the vertical bore hole). This process of pushing arm 19 retracting, trigger switch 17 activating thereby, and hammer device 15 pushing another pipe segment into the launch position is repeated until the desired (predetermined) number of pipe segments have been launched for this particular lateral run of pipe segments, or when the pushing arm encounters too much resistance, or when a special pipe segment must be inserted. The tool is then either retrieved and brought to the surface for re-loading of pipe segments, or just the pipe rack 6 is retrieved and additional pipe segments are added to the rack while the rest of the tool remains in the vertical bore hole.

In more detail about pushing arm 19, in one embodiment, it is part of a jaw which is essentially two arms, one of which is fixed against the tool frame 1, and the other is the pushing arm 19 which moves the shuttling block 19A and thereby the pipe segment.

To reload the rack, pipe segments (7, 8, or 9) that will become segments in the laterally drilled pipe at a desired depth are loaded at the surface in the rack 6. Tab 10*a* on rack 6 holds the pipe segments in place in the rack as explained above. Then the rack is lowered into the hole, inside the tool frame where the rack is guided into place by frame guides 4. Rack 6 then mates with rack receiving unit 13 through mating latching mechanism 10, bar 11 and latch releasing mechanism 14, and tab 10*a* is opened, allowing pipe segments (7, 8 or 9) to drop down one at a time to the lowermost position in the rack.

When pipe launching must be interrupted or halted, the rack is removed by pulling on support cable 6B. Upon separating from the rack receiving unit, tab 10*a* returns to its default position holding the pipe segments, and the remaining pipe segments, if any, are held inside the rack as the rack is brought to the surface. At the surface, the rack can be reloaded before repeating the drilling process.

At the surface, these operations can be monitored from down hole by using the video camera(s).

Upon completion of a lateral well, last pipe segment 9 can be fitted with a pre-attached conduit 52 to the surface to allow for injection of fluids into the newly drilled lateral well, or for extraction of fluid from that lateral well.

Assembling the Lateral Drilling Tool

The lateral tool can be built as follows:

First, build the frame 1.

Second, insert the power unit 20 including the pushing arm 19 and its power line and attach the power unit to the frame. Insert and attach the dual rails and rack receiving unit 13. If used, stabilizing plug 70 is attached to the bottom of frame 1. Attach the video camera(s) and guides 4 for the rack.

Alternative Configurations of the System, Tool and Method

The system and tool can be modified by adding power units, for example, with paired power units acting in opposite directions. This would facilitate pipe insertion by providing counteractive force, stabilizing the tool. Multiple racks and therefore multiple rack receiving units (e.g., dual racks and dual rack receiving units) can be installed for multiple or simultaneous lateral pipe launching.

The unit can be operated in horizontal pipes to drill vertical wells or additional horizontal or diagonal pipe runs (normal or transverse to the first bore hole). The pipe loading mechanism may require modification to ensure proper feeding of pipe segments into the launch position.

The unit can be used to inject pipe segments that are prepackaged with chemicals for cleanup of contamination or other purpose. The pipe segments can be made of hard but degradable outer material and be filled with chemicals or materials designed to be interacting with the soil or rock in the target area. The material in the pipe segments can also consist of compounds known to expand in volume, thereby promoting fracturing of the ground penetrated by the lateral pipe segments.

The initial pipe segment can also be shaped in a screw-like or auger shape to induce rotation of the pipe segments in the soil or rock to facilitate penetration.

The inserted pipe segments can also be constructed with pre-packed sand filters, or other protective layers affixed to the pipe segments prior to insertion. The pipe segments can have hexagonal, oval or other cross-sectional shape. The inserted pipe segments can also be linked to each other or be equipped with inner tubing. The pipe segments can be blank or can contain slits, holes or louvers to allow for fluid flow.

The last pipe segment to be inserted in a single lateral conduit can be connected to a hose or conduit extending to the surface for extraction of fluids and/or for injection of fluids. The frame's lower section can be designed with a gap to allow for removal of the lateral drilling tool while leaving in place the finished lateral well still connected to the conduit.

The pipe receiving and launching section components can also be located in a different stacking order to allow, for example, pushing of the pipe segments from the bottom of the tool.

Alternative Uses

The system, tool and method can be used for other applications where lateral drilling from an initial hole is needed, such as fracturing of subsurface soil or rock, construction of underground utilities, installation of piping in any construction project in areas of limited space.

The system, tool and method are primarily intended to be used in shallow soil and shallow groundwater applications. Modifications of the system, tool and method from hydraulic jaw operations to more powerful applications may allow for uses in fluid injection or extraction in harder soil or rock.

For shallow soil, the most direct application of the system, tool and method is for remediation of soil and groundwater contaminated zones.

Fine Grained Soil Fracturing

The insertion of the pipe segments in fine-grain, low permeability soil will create open conduits, significantly increasing the permeability of the soil, to allow for greater flow rates of fluids to be injected or extracted from the soil. This use of the tool for increased permeability is the simplest, yet significantly important use of the tool. The use of a collapsible casing for this application may not be required.

Soils Suitable for Drilling

In a preferred depth range of ten or twenty feet to about two hundred feet, clay is very common Clay is a naturally occurring aluminum silicate composed primarily of fine-grained minerals. Clays are distinguished from other fine-grained soils by differences in size and mineralogy. Silts may also be encountered. Silts are fine-grained soils that may not include clay minerals, tend to have larger particle sizes than clays, but there is some overlap in both particle size and other physical properties, and there are many naturally occurring deposits which include both silts and clays.

The system, tool and method may also be used in sands, gravels and organics or combinations thereof. As discussed above, greater depths, e.g., in the thousands of feet, and use in hard formations such as rocks in other embodiments are possible.

The classification of the soil may be by the Unified Soil Classification System, or by the AASHTO Soil Classification System.

Injection of Chemicals Loaded into Cartridges in Each Pipe Segment

The tool can be used to inject chemicals in contaminated zones to remediate soil or groundwater contamination. The injection of chemicals can be by storing chemicals within the pipe segments inserted by the tool. This direct injection of chemical-loaded pipe segments could also be done without the use of the collapsible casing. Injection of chemicals can be made for in-situ chemical oxidation or enhanced bioremediation. The chemicals inserted in the pipe segments to be injected in the ground can also consist of chemicals designed to modify the physical or chemical characteristics of the soil, such as chemicals known to expand in size over time, and this use would result in the creation of fractures in the ground that may be desirable for fluid insertion or extraction or for other purposes.

Injection of Chemicals Through Laterally Drilled Pipes

The injection of chemicals in contaminated soils or in groundwater zones can also be conducted through pipe segments inserted by the system, tool and method, where the accumulated pipe segments form lateral pipes, like roots, connected to the central vertical bore hole. The lateral pipes are used as conduits for single or multiple episodes of chemical injection. After one or more horizontal pipes are constructed by the system, tool and method, any injection of chemicals inside the central borehole will also reach the lateral pipes and for wider reach of the chemicals.

For some applications of chemical oxidation where more than one chemical is inserted, a dual set of parallel pipes may be drilled, with specially-timed injection of chemical compounds in each pipe to effect catalytic or other activation reactions. Lateral pipes can also be used for sparging of air or gases to the subsurface.

Enhanced Groundwater Extraction

The laterally drilled pipes can also be used where groundwater is extracted from the well: the additional lateral pipes, forming root-like extensions of the bore holes, will allow for larger rates of fluid extraction.

Enhanced Extraction of Soil Gas in the Vadose Zone:

A well drilled in the vadose zone for soil gas extraction can also be built with laterally drilled pipes, where the added lateral pipes will allow for a wider reach of extraction than single vertical pipes.

Mitigation of Vapor Intrusion from Subsurface to Above Ground Buildings

Laterally drilled pipes can also be built from vertical wells adjacent to structures (houses, buildings) from under which vapors are extracted to reduce vapor intrusion concerns where volatile chemical or flammable compounds are threatening intrusion to above ground structures.

Geothermal Heating/Cooling Application

Laterally drilled pipes can also be used as part of the network of subsurface pipes used in geothermal heating/cooling loop installation built as energy saving systems.

Possible Oil, Gas, Geothermal Application

If the hydraulic jaw power unit 20 can be expanded and strengthened, lateral drilling may be applicable to drilling into harder rock formations, possibly enhancing groundwater, steam, gas, or oil extraction.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part. For example, the loading system may be modified to load pipes at an angled orientation and/or bracing mechanisms other than or in addition to a stabilizing plug may be used, if desired.

What is claimed is:

1. A tool for boring holes transversely to and inside a first hole, the tool comprising;

(i) a frame;

(ii) a pipe launching unit mounted in the frame and having a set of rails for receiving a pipe segment in a pipe launching position; and (iii) a power unit mounted in the frame having a pushing arm for pushing the pipe segment in an axial direction of the pipe segment, wherein the pushing arm moves from a ready position to a final position along a substantial axial direction of the pipe segment in a launching direction.

2. The tool of claim 1, further comprising a rack for holding multiple pipe segments, the rack being movable towards and away from the pipe launching unit, a latching mechanism for holding the pipe segments in the rack, and a rack receiving unit having a latch release mechanism for mating with and causing the latching mechanism to open and release a pipe segment.

3. The tool of claim 2, wherein the rack receiving unit further comprises a hammer device for moving into a contact position for pushing a pipe segment in a bottom position in the rack out of the rack for the movement to the pipe launching position.

4. The tool of claim 3, wherein the hammer device is responsive to the pushing arm returning to the ready position.

5. The tool of claim 4, wherein the hammer device, when in the contact position, is also adapted for holding the pipe segments, other than the pipe segment in the bottom position, from movement towards the bottom position.

6. The tool of claim 1, further comprising a rack for holding multiple pipe segments, the rack being movable towards and away from the pipe launching unit.

7. The tool of claim 6, further comprising a hammer device for pushing a pipe segment in a bottom position in the rack out of the rack for movement to the pipe launching position.

8. The tool of claim 1, wherein the tool is for boring holes substantially normal to the first hole.

9. The tool of claim 1, wherein the first hole is substantially vertical.

10. The tool of claim 1, wherein the pushing arm is powered by one of hydraulic and pneumatic energy.

11. A tool for boring holes transversely to and inside a first hole, the tool comprising:

(i) a frame;

(ii) a pipe launching unit mounted in the frame and having a pipe receiving section for receiving a pipe segment in a pipe launching position;

(iii) a pipe pushing device mounted in the frame for pushing pipe segment in an axial direction of the pipe segment; and (iv) a rack for holding multiple pipe segments, the rack being movable towards and away from the pipe launching unit, a latching mechanism for holding the pipe segments in the rack, and receiving unit having a latch release mechanism for mating with and causing the latching mechanism to open and release a pipe segment.

12. The tool of claim 11, wherein the rack receiving unit further comprises a hammer device for moving into a contact position for pushing a pipe segment out of the rack for movement to the pipe launching position.

13. The tool of claim 12, wherein the hammer device is responsive to the pipe pushing device returning to a ready position.

14. The tool of claim 13, wherein the hammer device, when in the contact position, is also adapted for holding the pipe segments, other than the pipe segment in the bottom position, from movement towards the bottom position.

15. The tool of claim 11, further comprising a hammer device for pushing a pipe segment in a bottom position in the rack out of the rack for movement to the pipe launching position.

16. The tool of claim 11, wherein the tool is for boring holes substantially normal to the first hole.

17. The tool of claim 11, wherein the first hole is substantially vertical.

18. The tool of claim 11, wherein the pipe pushing device is powered by one of the hydraulic and pneumatic energy.

* * * * *